US009623269B2

(12) United States Patent
Oddou et al.

(10) Patent No.: US 9,623,269 B2
(45) Date of Patent: Apr. 18, 2017

(54) SYSTEMS FOR ASSISTED BRAKING BELAY WITH A CAM-CLUTCH MECHANISM

(71) Applicants: Paul Oddou, Salt Lake City, UT (US); Jake Hall, Draper, UT (US); Bill Belcourt, Salt Lake City, UT (US); Ben Walker, Draper, UT (US)

(72) Inventors: Paul Oddou, Salt Lake City, UT (US); Jake Hall, Draper, UT (US); Bill Belcourt, Salt Lake City, UT (US); Ben Walker, Draper, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 0 days.

(21) Appl. No.: 14/206,444

(22) Filed: Mar. 12, 2014

(65) Prior Publication Data

US 2014/0262611 A1 Sep. 18, 2014

Related U.S. Application Data

(60) Provisional application No. 61/785,770, filed on Mar. 14, 2013.

(51) Int. Cl.
*A62B 1/14* (2006.01)

(52) U.S. Cl.
CPC ..... *A62B 1/14* (2013.01)

(58) Field of Classification Search
CPC ..... A62B 1/14; A62B 35/005; A62B 35/0081; A62B 1/10; A62B 1/16; A63B 29/02
See application file for complete search history.

(56) References Cited

U.S. PATENT DOCUMENTS

| | | | | |
|---|---|---|---|---|
| 4,254,941 | A * | 3/1981 | Tanson | 254/267 |
| 4,533,026 | A * | 8/1985 | Bernard | 188/184 |
| 4,923,037 | A * | 5/1990 | Stephenson et al. | 188/188 |
| 4,938,435 | A * | 7/1990 | Varner et al. | 244/142 |
| 5,845,894 | A * | 12/1998 | Petzl et al. | 254/391 |
| 6,056,086 | A * | 5/2000 | Gortan et al. | 182/197 |

(Continued)

FOREIGN PATENT DOCUMENTS

| | | |
|---|---|---|
| EP | 1834672 A1 | 10/2007 |
| EP | 1873407 A1 | 1/2008 |

(Continued)

OTHER PUBLICATIONS

Http://eprints.usq.edu.au/33/.

*Primary Examiner* — Katherine Mitchell
*Assistant Examiner* — Shiref Mekhaeil
(74) *Attorney, Agent, or Firm* — Trent Baker; Baker & Associates PLLC

(57) ABSTRACT

One embodiment of the present invention relates to an assisted braking belay system with a housing, camming mechanism, and clutch mechanism. The housing may include a substantially enclosed rope channel through which a rope may extend to the climber. The camming mechanism is moveably coupled to the housing and configured to automatically engage a camming surface upon the rope across the rope channel if the rope translates through the channel at a particular acceleration rate. The clutch mechanism may function as a secondary locking mechanism to engage the camming surface of the camming mechanism upon the rope across the rope channel.

20 Claims, 10 Drawing Sheets

(56) References Cited

U.S. PATENT DOCUMENTS

| | | | | |
|---|---|---|---|---|
| 6,223,868 | B1 * | 5/2001 | Wullimann | 188/188 |
| 6,378,650 | B2 * | 4/2002 | Mauthner | 182/5 |
| 6,732,833 | B2 * | 5/2004 | Rogelja | 182/5 |
| 6,810,997 | B2 | 11/2004 | Schreiber | |
| 6,814,185 | B1 * | 11/2004 | Ostrobrod | 182/193 |
| 7,055,651 | B2 | 6/2006 | Klingler | |
| 8,261,881 | B2 | 9/2012 | Plaze | |
| 8,312,965 | B2 | 11/2012 | Petzl | |
| 8,316,989 | B2 | 11/2012 | Bamberg | |
| 8,376,081 | B2 | 2/2013 | Schwarzenbach | |
| 8,387,218 | B2 | 3/2013 | Strasser | |
| 2002/0112917 | A1 * | 8/2002 | Ador | 182/5 |
| 2002/0179372 | A1 * | 12/2002 | Schreiber et al. | 182/238 |
| 2003/0051944 | A1 | 3/2003 | Shea | |
| 2004/0020727 | A1 * | 2/2004 | Petzl et al. | 188/65.1 |
| 2005/0061588 | A1 | 3/2005 | Klingler | |
| 2005/0082115 | A1 * | 4/2005 | Petzl et al. | 182/5 |
| 2006/0207829 | A1 * | 9/2006 | Mauthner | 182/5 |
| 2007/0215411 | A1 * | 9/2007 | Petzl et al. | 182/193 |
| 2007/0235254 | A1 * | 10/2007 | Soucek | 182/11 |
| 2008/0157042 | A1 * | 7/2008 | Jacobson et al. | 254/270 |
| 2008/0210488 | A1 * | 9/2008 | Tarkhani et al. | 182/5 |
| 2009/0084630 | A1 * | 4/2009 | Argoud | 182/192 |
| 2009/0178887 | A1 * | 7/2009 | Reeves et al. | 182/239 |
| 2010/0308149 | A1 * | 12/2010 | Allington et al. | 242/379 |
| 2011/0011671 | A1 | 1/2011 | Chu | |
| 2011/0048852 | A1 * | 3/2011 | Wolf et al. | 182/5 |
| 2011/0073417 | A1 * | 3/2011 | Chaumontet et al. | 188/65.5 |
| 2011/0138587 | A1 | 6/2011 | Walker | |
| 2011/0284323 | A1 | 11/2011 | Ayre | |
| 2012/0012800 | A1 * | 1/2012 | Chaumontet | 254/391 |
| 2012/0111665 | A1 | 5/2012 | Paglioli | |
| 2012/0228062 | A1 | 9/2012 | Taylor | |
| 2012/0241700 | A1 * | 9/2012 | Mauthner et al. | 254/391 |
| 2013/0032433 | A1 * | 2/2013 | Codega | 182/5 |
| 2013/0036579 | A1 | 2/2013 | Christianson | |
| 2014/0020988 | A1 * | 1/2014 | Casebolt et al. | 188/65.1 |
| 2014/0138191 | A1 * | 5/2014 | Chabod et al. | 188/65.1 |
| 2014/0196984 | A1 * | 7/2014 | Chabod et al. | 182/18 |
| 2014/0196989 | A1 * | 7/2014 | Moine et al. | 188/65.1 |
| 2014/0262610 | A1 * | 9/2014 | Oddou et al. | 182/5 |

FOREIGN PATENT DOCUMENTS

| | | | |
|---|---|---|---|
| EP | 2042217 | B1 | 4/2010 |
| EP | 1909921 | B1 | 11/2012 |
| EP | 2554219 | A1 | 2/2013 |

* cited by examiner

SYSTEMS FOR ASSISTED BRAKING BELAY WITH A CAM-CLUTCH MECHANISM

RELATED APPLICATIONS

This application claims priority to U.S. provisional application Ser. No. 61/785,715 filed Mar. 14, 2013, the contents of which are incorporated by reference.

FIELD OF THE INVENTION

The invention generally relates to belay devices with assisted braking, self-arresting belay devices, and automatic locking belay devices for climbing related activities. In particular, the present invention relates to an assisted braking belay system with a cam-clutch mechanism.

BACKGROUND OF THE INVENTION

A belay device is used by a belayer in the act of belaying a climber. During general operation, the belay device is coupled to the belayer, who feeds excess rope to the climber through the belay device as the climber ascends. In the event that the climber falls, the belayer and belay device selectively hold or lock a region of the rope, thereby tensioning the rope between the belayer and climber and thus arresting the climber's fall. Belay devices are also used to lower the climber by controlling the speed at which excess rope is fed through the belay device while the rope is under tension from the climber's weight.

One type of belay device is generally referred to as a belay device with assisted braking, a self-arresting belay device, an automatic belay device, and/or an auto-locking belay device because it contains a mechanism to automatically increase the friction on the rope in the event of a climber fall. A second type of belay device is referred to as passive because it requires the belayer to manually increase the friction on the rope in the event of a climber fall. For safety reasons, an auto-locking belay device is preferred because it increases the likelihood of arresting a climber's fall despite the actions of the belayer.

One of the problems or limitations with conventional auto-locking belay devices is the ability for the belayer to defeat or disengage the auto-locking mechanism, thereby allowing the intercoupled rope to continuously feed while a climber is falling. To enable a belayer to efficiently feed rope to the climber during normal ascent, the auto-locking mechanism of any belay device must include a technique or method by which the belayer may circumvent or minimize friction upon the rope. For example, the belayer may place a portion of their hand on a particular region of the belay device so as to minimize friction and/or disengage the auto-locking mechanism while feeding rope. Unfortunately, if the climber falls while the belayer is circumventing or minimizing the auto-locking mechanism, the auto-locking mechanism may fail to engage, fail to apply sufficient friction on the rope, and therefore fail to arrest the climber's fall.

Therefore, there is a need in the industry for an auto-locking or assisted braking belay device that minimizes the ability of a belayer to defeat or disengage the auto-locking mechanism while maintaining efficient rope feeding capability.

SUMMARY OF THE INVENTION

The present invention relates to assisted braking belay systems. One embodiment of the present invention relates to an assisted braking belay system with a housing, camming mechanism, and clutch mechanism. The housing may include a substantially enclosed rope channel through which a rope may extend to the climber. The camming mechanism is moveably coupled to the housing and configured to automatically engage a camming surface upon the rope across the rope channel if the rope translates through the channel at a particular acceleration rate. The clutch mechanism may function as a secondary locking mechanism to engage the camming surface of the camming mechanism upon the rope across the rope channel. The clutch includes a pulley partially disposed within the rope channel and rotatably coupled to the camming mechanism. The pulley is configured such that translation of the rope through the rope channel causes the pulley to rotate with respect to the camming mechanism. The clutch mechanism further includes a centrifugal member coupled to the pulley and disposed within a circular region. The rotational speed of the pulley causes the centrifugal member to correspondingly rotate within the circular region. If the pulley rotates above a particular speed, the centrifugal member engages with the circular region and obstructs rotation of the pulley. If the pulley is obstructed from rotation, the pulley imposes a particular frictional force upon the rope and encourages the camming mechanism to engage the camming surface upon the rope across the rope channel.

Embodiments of the present invention represent a significant advance in the field of assisted braking belay systems. As described above, conventional assisted braking belay systems are limited to single camming mechanisms which may be defeated or circumvented by the belayer, resulting in potential injury to the climber. Embodiments of the present invention incorporate both a camming mechanism and a clutch mechanism configured to engage a camming surface upon the rope. Therefore, if the primary operation of the camming mechanism is improperly defeated by the belayer while the climber is falling or lowering, the secondary clutch mechanism will automatically engage the camming surface upon the rope.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

One embodiment of the present invention relates to an assisted braking belay system with a housing, camming mechanism, and clutch mechanism. The housing may include a substantially enclosed rope channel through which a rope may extend to the climber. The camming mechanism is moveably coupled to the housing and configured to automatically engage a camming surface upon the rope across the rope channel if the rope translates through the channel at a particular acceleration rate. The clutch mechanism may function as a secondary locking mechanism to engage the camming surface of the camming mechanism upon the rope across the rope channel. The clutch includes a pulley partially disposed within the rope channel and rotatably coupled to the camming mechanism. The pulley is configured such that translation of the rope through the rope channel causes the pulley to rotate with respect to the camming mechanism. The clutch mechanism further includes a centrifugal member coupled to the pulley and disposed within a circular region of the camming mechanism. The rotational speed of the pulley causes the centrifugal member to correspondingly rotate within the circular region. If the pulley rotates above a particular speed, the centrifugal member engages with the circular region and obstructs rotation of the pulley. If the pulley is obstructed from rotation, the pulley imposes a particular frictional force upon the rope and encourages the camming mechanism to engage the camming surface upon the rope across the rope channel. Also, while embodiments are described in reference to an assisted braking belay system, it will be appreciated that the teachings of the present invention are applicable to other areas.

Reference is initially made to FIGS. 1-4, which illustrate one embodiments of an assisted braking belay system with a cam-clutch mechanism in accordance with embodiments of the present invention, designated generally at 100. The assisted braking belay system 100 is designed to be used by a belayer in the act of belaying a climber (not shown). The act of belaying a climber includes coupling the belay system to the belayer and feeding a rope 110 through the system corresponding to the rate of controlled ascent or descent of the climber. Therefore, as the climber ascends a particular distance, the belayer feeds a corresponding distance of rope. The belay system 100 may be referred to as automatic or assisted because it includes at least one mechanism that automatically locks or applies a high degree of friction upon a section of the rope 110 if the rope accelerates or jerks above a particular rate. For example, if the climber falls, the climber's falling force will impart tension on the rope, thereby causing the rope to accelerate or jerk through the system 100 at a particular rate.

Figure 1:
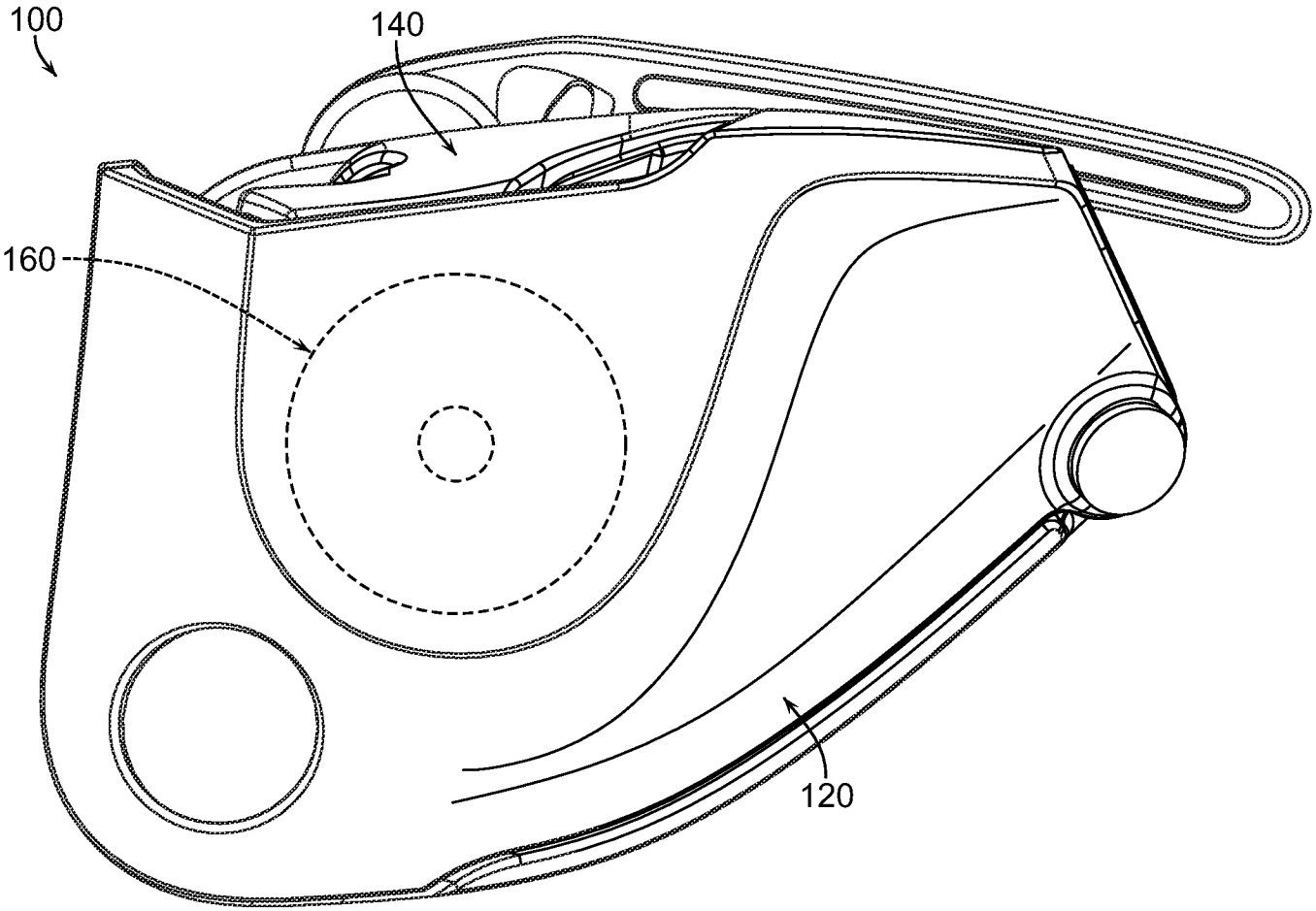
FIG. 1 illustrates an automatic belay system with a cam-clutch mechanism in accordance with embodiments of the present invention.
Figure 2:
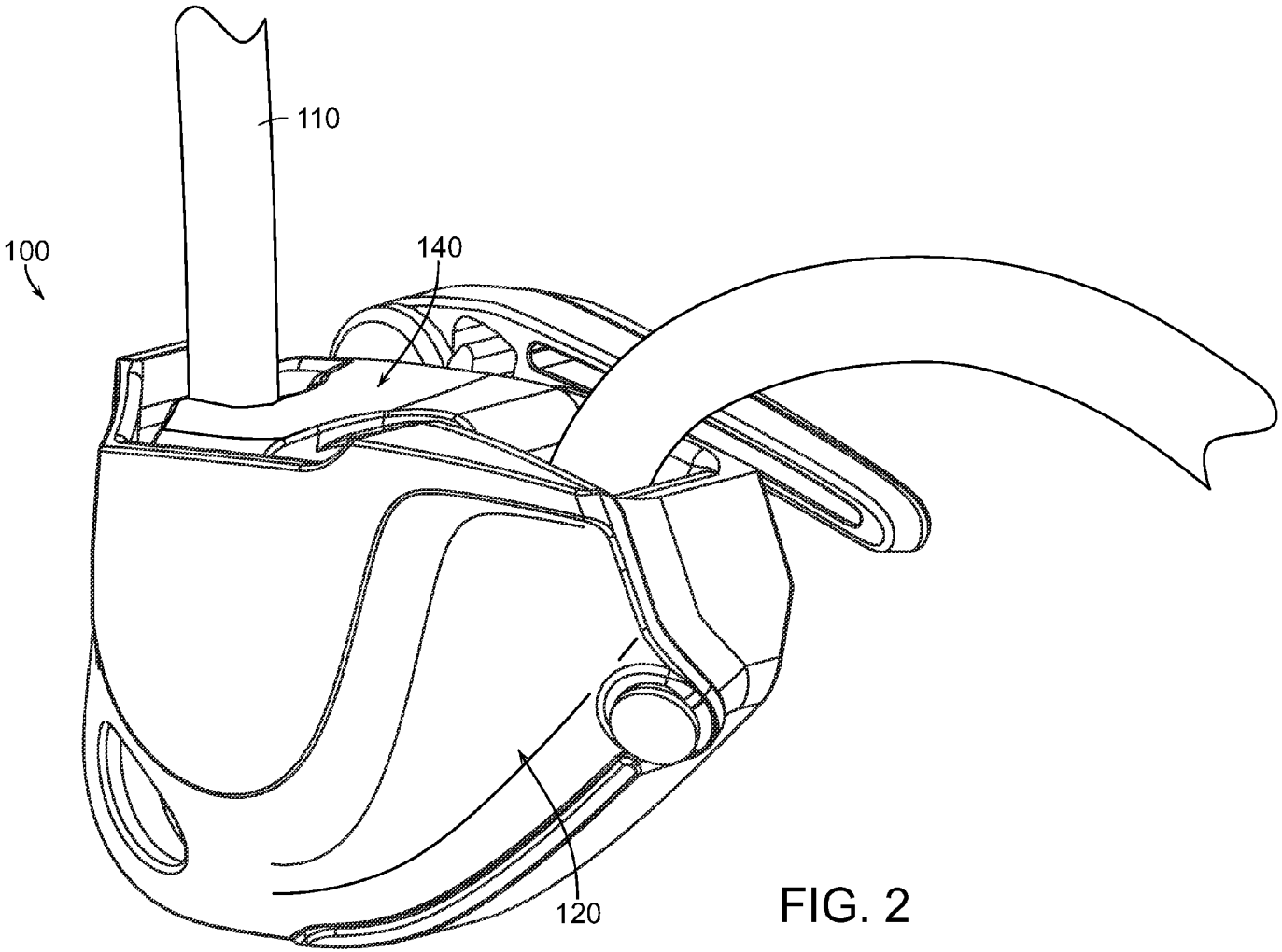
FIG. 2 illustrates that automatic belay system of FIG. 1 further illustrating the housing in the closed state and camming mechanism in the free state.
Figure 3:
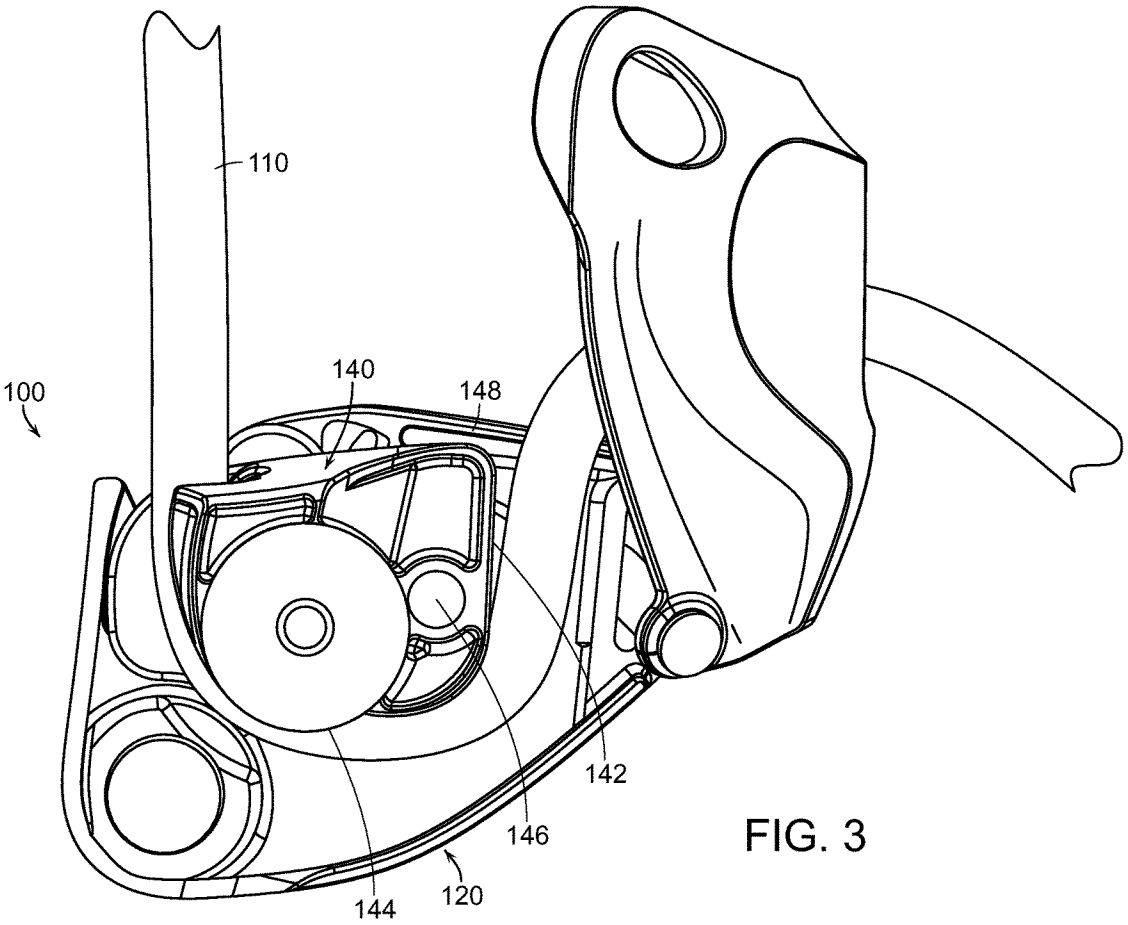
FIG. 3 illustrates that automatic belay system of FIG. 1 further illustrating the housing in the open state and camming mechanism in the free state.
Figure 4:
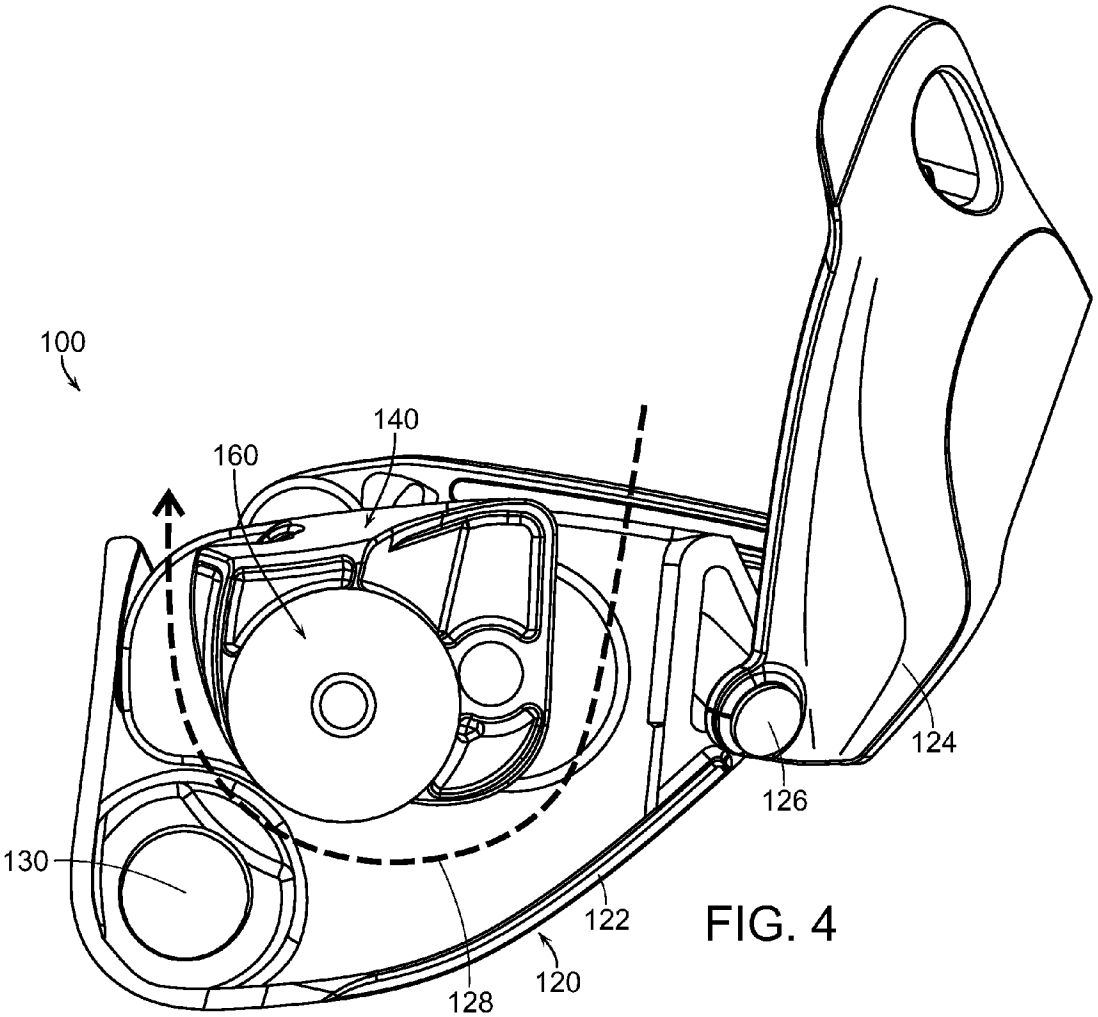
FIG. 4 illustrates that automatic belay system of FIG. 1 further illustrating the housing in the open state and camming mechanism in the free state.
Figure 5:
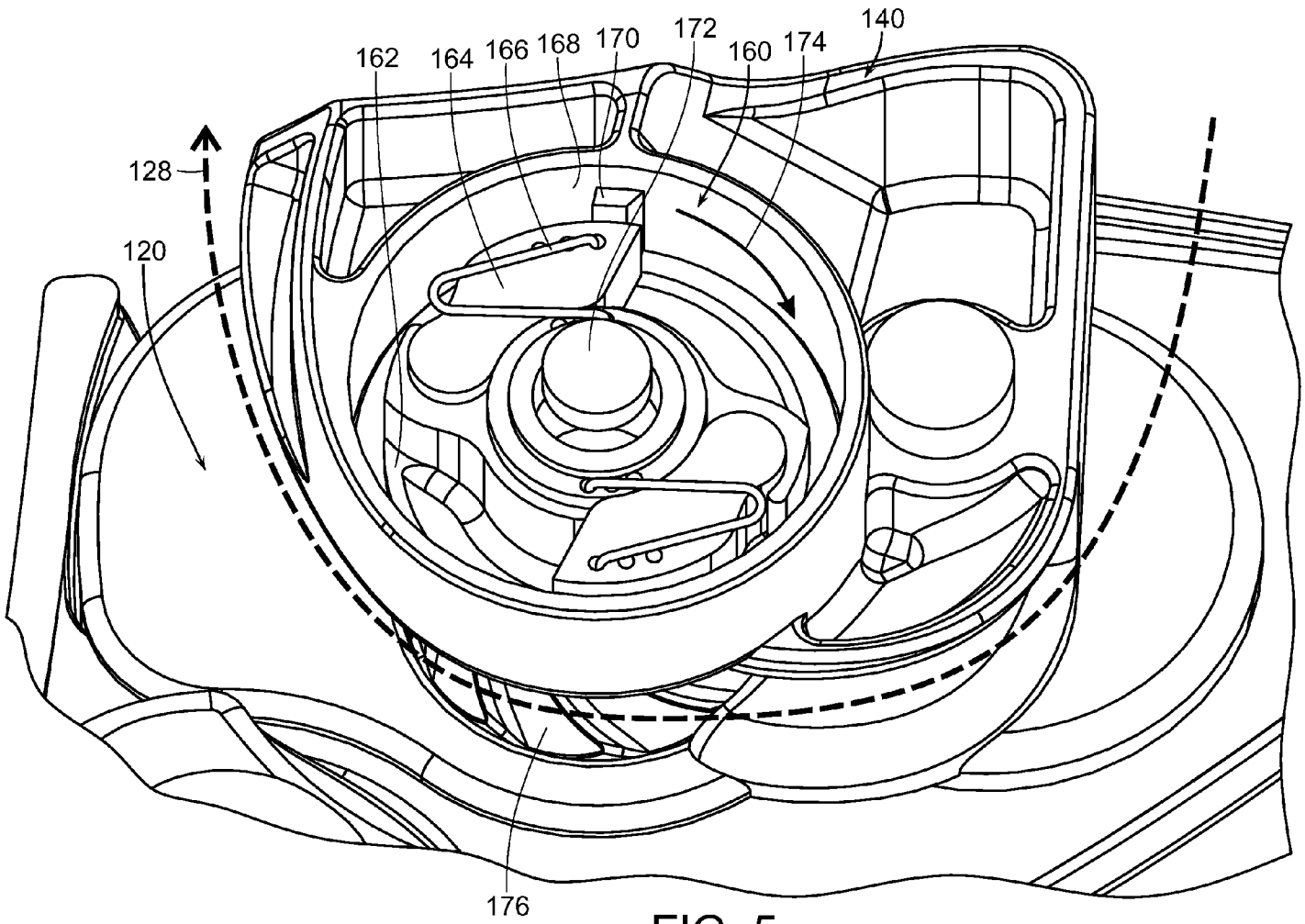
FIG. 5 illustrates a cross-sectional view of the automatic belay system illustrated in FIG. 1 with the cam-clutch mechanism in the disengaged state.

The system 100 generally includes a housing 120, a camming mechanism 140, and a clutch mechanism 160. The housing 120 includes an open state (FIGS. 3-4) and a closed state (FIGS. 1-2). The camming mechanism 140 includes a cammed state (not shown) and a free state (FIGS. 3-4). The clutch mechanism 160 includes an engaged state (FIGS. 6, 8, 10) and a disengaged state (FIGS. 5, 9). For simplicity, specific figures are utilized to illustrate the components and operations of the housing 120, camming mechanism 140, and clutch mechanism 160. The components of the housing 120 are specifically illustrated and designated in detail in FIG. 4. The components of the camming mechanism 140 are specifically illustrated and designated in detail in FIG. 3. The components of the clutch mechanism 160 are specifically illustrated and designated in the cross-sectional FIGS. 5-10. The housing 120 further includes a rope channel 128, a top plate 124, a bottom plate 122, an opening 130, and a coupler 126. The open state of the housing 120 illustrated in FIG. 4 includes the top plate 124 rotated or pivoted about the coupler 126 from the bottom plate 122. The top plate 124 may be rotatably coupled to the bottom plate 122 at an off-axis angle to enable the top plate to articulate over the camming mechanism 140 and clutch mechanism 160 in the closed state. The term off-axis angle refers to an angle that is at least five degrees off orthogonal to the lengthwise axis of the housing 120. For example, FIG. 2 illustrates the housing 120 with a substantially horizontal axis and the top plate 124 is configured to rotate about an axis that is at least five degrees out. The optional off-axis angle provides a greater internal region between the top and bottom plates 124, 122, thereby providing more space for the camming mechanism 140 and clutch mechanism 160 in the closed state of the housing 120.

In operation, the open state of the housing 120 is used to load a rope 110 into the rope channel 128 (FIG. 3). A user specifically orients the rope in a clockwise manner extending to the climber. The illustrated left end or clockwise termination of the rope channel 128 should be configured with a rope 110 portion that extends directly to the climber. Likewise, the illustrated right end or clockwise initiation of the rope channel 128 should be configured with a rope 110 portion that does not extend to the climber. Initially, the user loads the rope 110 into the rope channel 128 of the bottom portion 122 of the housing 120 in the clockwise orientation illustrated and described. The user then rotates or pivots the top plate 124 over the bottom plate 122 (ie. counter-clockwise rotation), thereby substantially engaging the closed state of the housing 120 by enclosing the rope 110 within the rope channel 128 between the top plate 124 and the bottom plate 122. The closed state of the housing 120 also includes aligning the opening 130 on both the top and bottom plates 124, 122. A user may extend a carabiner or other releasable coupling device between the aligned openings 130 and the user's harness (not shown) so as to couple the system 100 to the user or belayer. The act of extending a coupler through the openings 130 of both the top and bottom plates 124, 122 locks the housing 120 into the closed state by preventing the top plate 124 from rotating and/or exposing the rope 110 and rope channel 128. This form of releasably coupling and securing an assisted braking belay system to a user/belayer is well known to those skilled in the art.

The primary automatic or assisted mechanism of the illustrated assisted braking belay system 100 is the camming mechanism 140. The term "primary" is in reference to the camming mechanisms' 140 functionality as an assisted braking mechanism. Alternatively, the camming mechanism 140 and clutch mechanism 160 may function "independently" rather than in a primary-secondary relationship. The camming mechanism 140 includes a free state (Illustrated in FIG. 3) and a cammed state (not shown but described below). The camming mechanism 140 is biased toward the free state by some form of biasing mechanism. The camming mechanism 140 is shaped and oriented within the system 100 such that it is in translatable communication with the rope 110 as it translates through the belay system. The components of the camming mechanism 140 are illustrated and designated in detail in FIG. 3. The illustrated camming mechanism 140 includes a camming surface 142, a bearing surface 144, a camming rotation point 146, and a lever 148. The camming mechanism 140 may be transitioned from the free state to the cammed state by overcoming a biasing force and rotating about the camming rotation point 146 with respect to the bottom plate 122 of the housing. The bearing surface 144 is oriented and shaped such that a clockwise manual translation of the rope 110 through the rope channel 128 forces the rope 110 to contact and impart a force upon the bearing surface 144. The bearing surface 144 may be concave shaped and protrude into the rope channel 128 for purposes of maintaining translational forces of the rope 110 upon the bearing surface 144. The maintenance of translation forces enables the bearing surface 144 to essentially detect the acceleration rate of the rope 110 through the rope channel 128. Therefore, if the translational acceleration of the rope 110 exceeds a particular rate or if the rope 110 is jerked in a particular manner, a rotational force is created on the camming mechanism 140 that exceeds the biasing force. Therefore, the camming mechanism 140 will rotate about the camming rotation point 146 with respect to the housing 120 so as to pivot or engage a portion of the camming surface 142 upon the rope 110 within the rope channel 128 (ie. transitioning from the free state to the cammed state). The engagement of the camming surface 142 upon the rope 110 (cammed state) may include translating a portion of the camming surface 142 across the rope channel 142 and restricting the rope channel 128 cross-sectional area, thereby increasing a translational friction force upon the rope 110 between the camming surface 142 and the housing 120. As the rope channel 128 is cross-sectionally restricted to a diameter smaller than the diameter of the rope 110, the translational friction force upon the rope 110 will increase and the translational rate of the rope 110 will decrease. The engagement of the cammed state may eventually entirely arrest the rope 110 translation through the rope channel 128 of the system 100 once a sufficient amount of translational friction force is applied to the rope 110 with respect to a rope 110 translation rate prior to engagement. The camming surface 142 and bearing surfaces 144 are also shaped and configured with respect to the rope channel 128 such that once the rope is arrested, the cammed state will be maintained while a sufficient tensile strength is maintained on the rope 110. The specific shape of the bearing surface 144, camming surface 142, cam rotation point 146, biasing mechanism, and rope channel 128 all contribute to the detection of the minimum rope translation acceleration rate or jerk upon the bearing surface 144. The camming mechanism 140 further includes a lever 148 intercoupled with the camming surface 142 and bearing surface 142 to provide a mechanical rotational advantage. The lever 142 may be used by the user to rotate the camming mechanism 140 with respect to the housing 120 to enable selective clockwise rope 110 translation while a particular tensile force is still on the rope 110. In addition, the camming mechanism 140 is configured to automatically transition from the cammed state to the free state once a particular tensile force is removed from the rope 110. It will be appreciated that various alternative camming mechanism 140 designs may be implemented in accordance with embodiments of the present invention, such as alternative camming/bearing surface shapes, coupling orientations, coupling frictional forces, etc. One skilled in the art will understand the operation of the camming mechanism 140 from the description above and the referenced figures.

In operation, the rope 110 is properly loaded into the rope channel 128, the housing 120 is in the closed state, the camming mechanism 140 is in the biased free state, and the system 100 is releasably coupled to the user/belayer. The belayer is able to sequentially feed or translate rope in a clockwise manner to the climber to enable ascent. If the climber falls, the rope 110 will accelerate or jerk through the system 100, causing a force upon the bearing surface 144. Once the force upon the bearing surface 144 overcomes the biasing force, the camming mechanism 140 will rotate, causing the camming surface to translate across the rope channel and impart a frictional force upon the rope 110. Once the frictional force upon the rope overcomes the translational force, the rope translation will cease, thereby fixing the rope length between the belayer and climber. The tensile force of the rope will maintain the cammed state and prevent further rope translation. This rope length fixing between the belayer and climber will have the effect of arresting the climber's fall and ceasing any further descent. The climber may then resume climbing, thereby removing the tensile force upon the rope and causing the camming mechanism 140 to automatically rotate back to the free state via the biasing force. Alternatively, the belayer may activate the lever 148 to partially rotate the camming mechanism 140 and allow the rope to translate through the system 100 at a controlled rate. The controlled translation of the rope 110 enables the belayer to lower the climber.

The novel secondary automatic mechanism of the illustrated assisted braking belay system is the clutch mechanism 160. The illustrated clutch mechanism 160 embodiment operates in conjunction with portions of the camming mechanism 140 to provide a combined "cam-clutch" mechanism by which to cease translation of the rope 110 through the system 100. As described above, alternative embodiments may utilize a clutch mechanism 160 that operates independently of the cam mechanism 140 to automatically arrest translation of the rope. The clutch mechanism 160 includes a default or biased disengaged state (FIGS. 5 and 9) and an engaged state (FIGS. 6, 8, and 10) that causes the camming mechanism to transition to the cammed state, thereby arresting translation of the rope 110 as described above. In contrast to the camming mechanism 140, the clutch mechanism 160 automatically transitions to the engaged state if a particular translational speed/rate of the rope is detected through the rope channel 128. Therefore, even if the rope translational acceleration is not sufficient to engage the camming mechanism 140, the clutch mechanism 160 may detect a sufficient rope translational speed to transition the clutch mechanism 140 to the engaged state, which then causes the camming mechanism 140 to transition to the cammed state. In the illustrated embodiments, the clutch mechanism 160 is disposed within the three dimensional region of the camming mechanism 140 and the housing 120 of the system; however, it will be appreciated that all or part of the clutch mechanism 160 may also be external to the camming mechanism 140 and/or the housing 120. The clutch mechanism 160 may be referred to as secondary to the camming mechanism or as a combined cam-clutch mechanism because it is configured to independently detect the rope translational speed through the system and then engage the camming surface 144 of the camming mechanism 140 against the rope 110. The clutch mechanism 160 provides an important backup or auxiliary detection system for situations of unwanted rope translation. For example, if the belayer restricts/defeats the operation of the camming mechanism 140 so as to quickly feed/translate rope to the climber, the camming mechanism 140 may not properly engage the cammed state in the event of a climber fall. Specifically, the camming mechanism 140 will fail to translate the camming surface 142 upon the rope 110, which may then result in a total system 100 belay failure (i.e. the climber would fall at a rate that is likely to result in injury). The clutch mechanism 160 includes an independent system to detect the translational rope speed apart from the camming mechanism 140. The clutch mechanism 160 may also be configured to impart a greater rotational force upon the camming mechanism 140 than the bearing surface 144 so as to engage the camming surface 142 upon the rope 110. The increased rotational force created by the clutch mechanism 160 on the camming mechanism 140 is designed to overcome whatever restriction may be impeding the camming mechanism 140 from arresting further translation of the rope 110. One embodiment of the operation and composition of the clutch mechanism 160 in conjunction with the camming mechanism 140 will be described below in reference to the cross-sectional FIGS. 5-10.

The purpose of a secondary automatic mechanism in the assisted braking system 100 is to lock or increase the friction upon the rope 110 in the event that the primary automatic mechanism is disengaged, minimized, or otherwise defeated by the belayer. The acts of feeding rope 110 and/or lowering a climber may require the belayer to in part restrict the operation of the primary automatic mechanism. For example, the act of efficiently feeding a larger section of rope (i.e. so that the climber may couple the rope to safety equipment) may require that the belayer restrict the camming mechanism 140 operation. Likewise, the act of lowering a climber requires selectively reducing the friction exerted upon the loaded rope 110 by the camming surface 142 to permit the rope to translate through the system. Both of these actions may be described as minimizing or circumventing the ability of the camming mechanism to automatically lock or increase friction on the rope. Therefore, the inclusion of a secondary automatic mechanism increases the reliability of the overall system to automatically lock or apply friction to the rope in the event that the rope translates through the system faster a particular speed.

Figure 6:
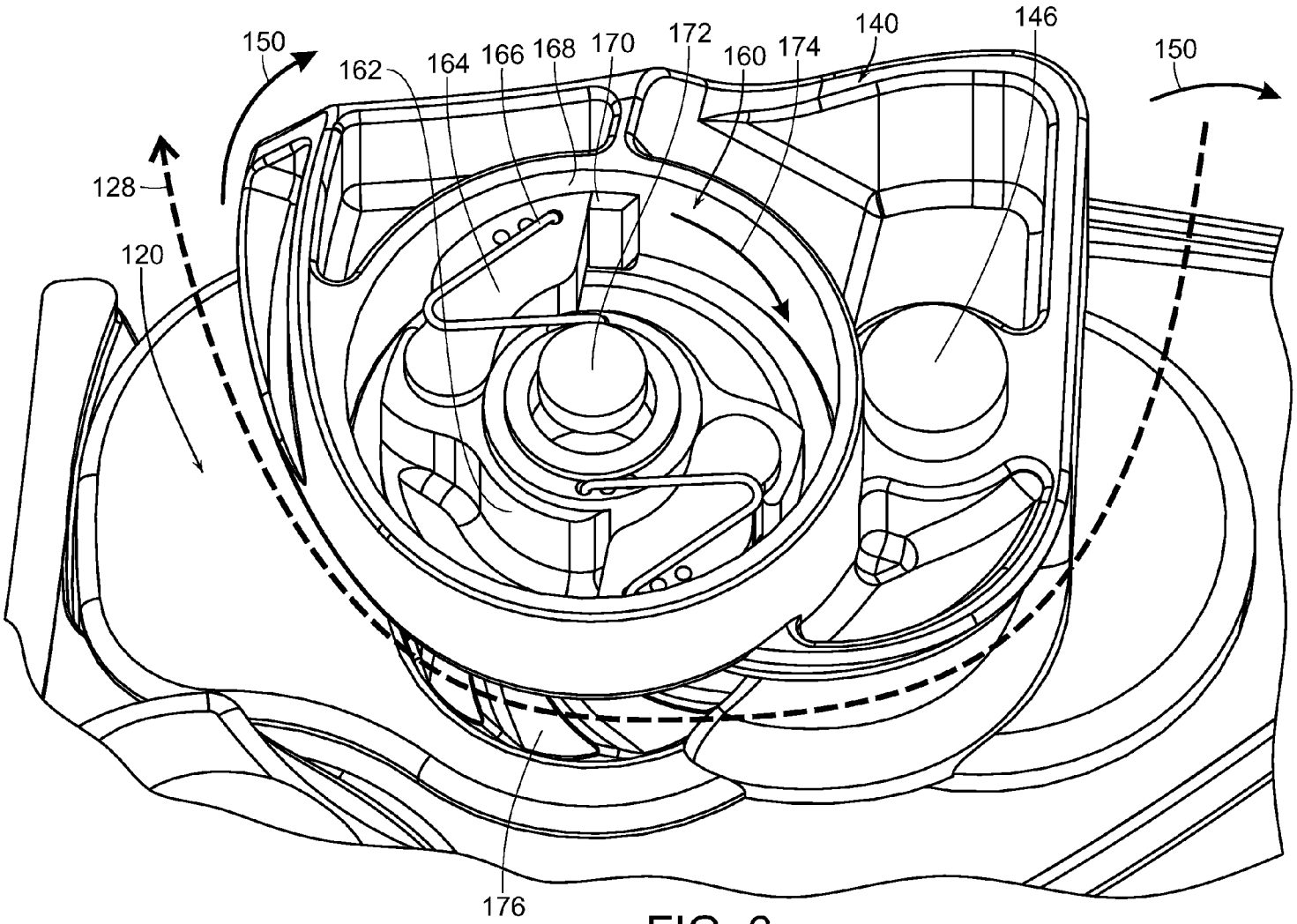
FIG. 6 illustrates a cross-sectional view of the automatic belay system illustrated in FIG. 1 with the cam-clutch mechanism in the engaged state.
Figure 7:
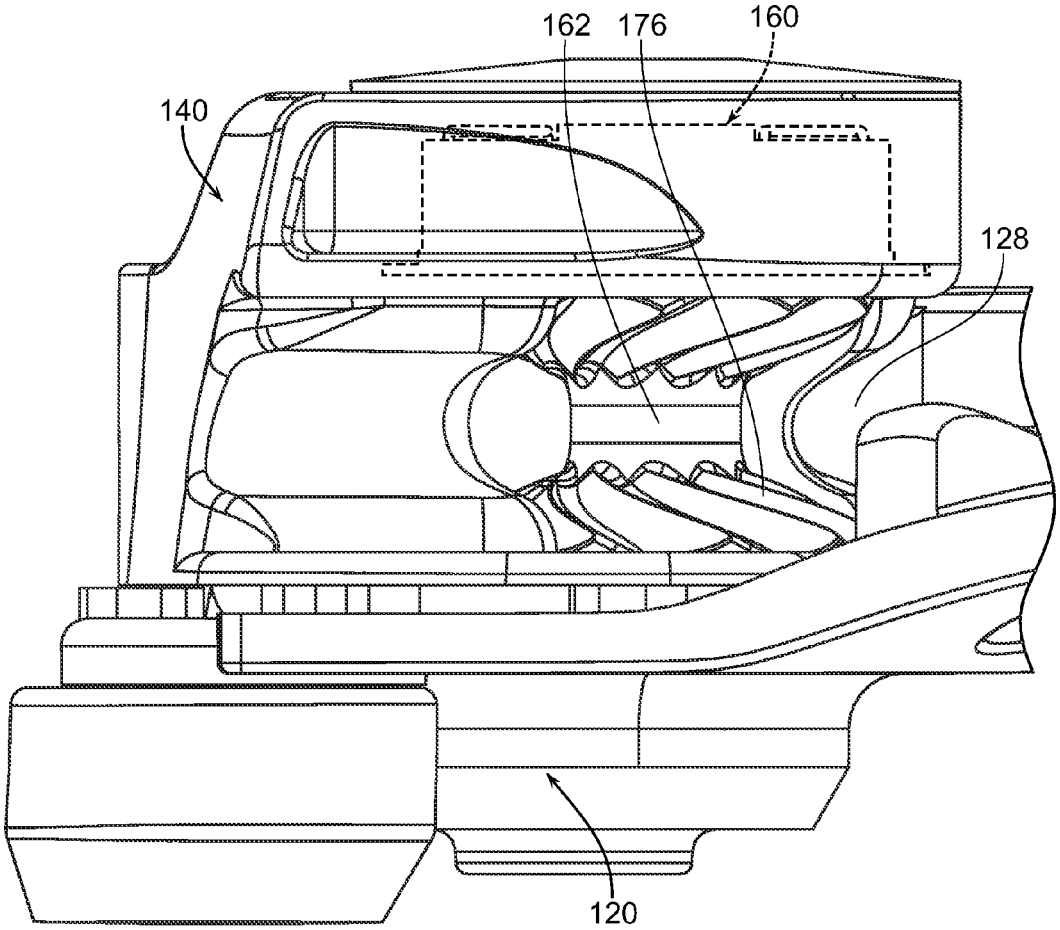
FIG. 7 illustrates a cross-sectional view of the automatic belay system illustrated in FIG. 1 showing a portion of the pulley of the cam-clutch mechanism.
Figure 8:
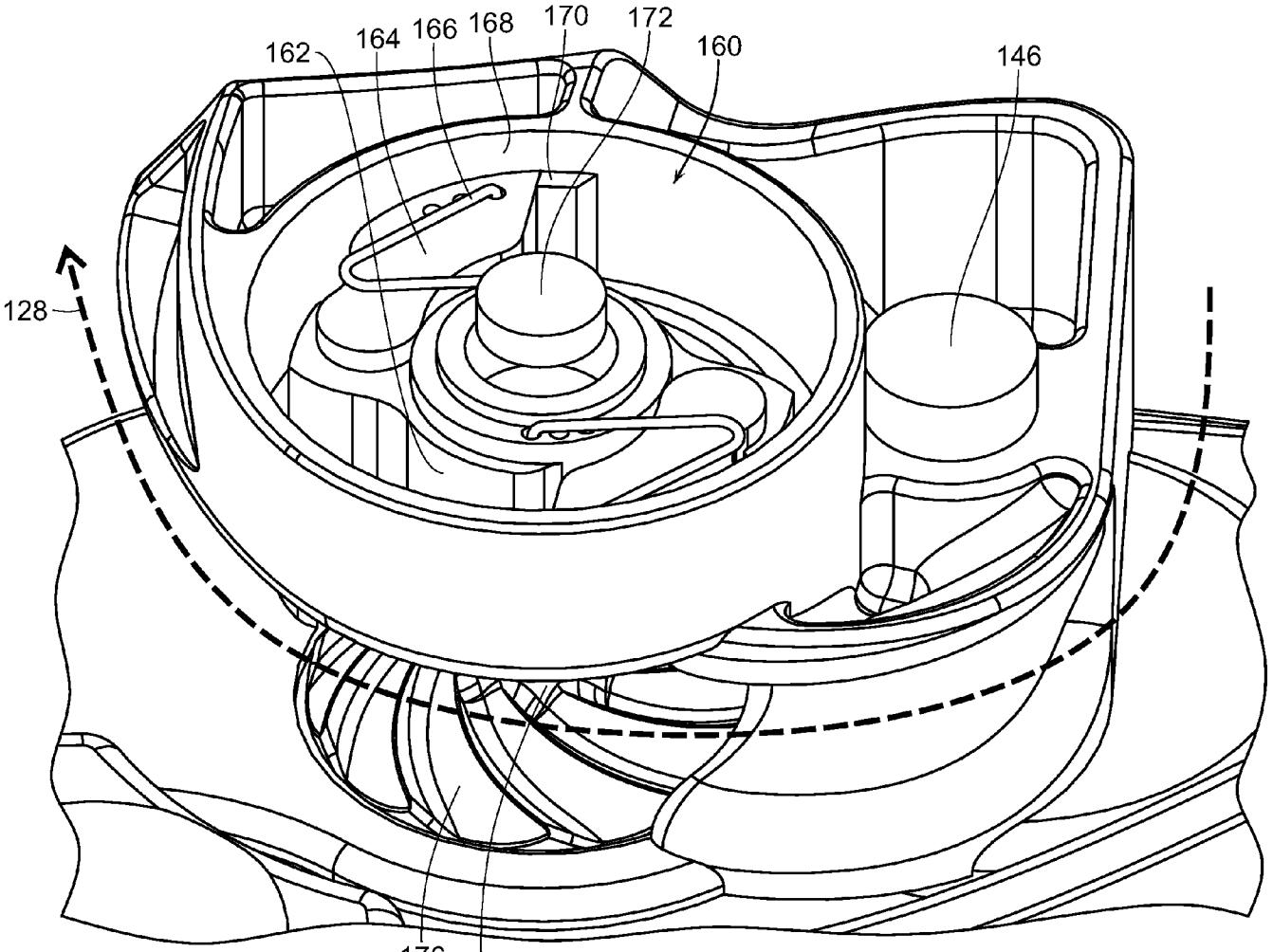
FIG. 8 illustrates a cross-sectional view of the automatic belay system illustrated in FIG. 1 with the cam-clutch mechanism in the engaged state.
Figure 9:
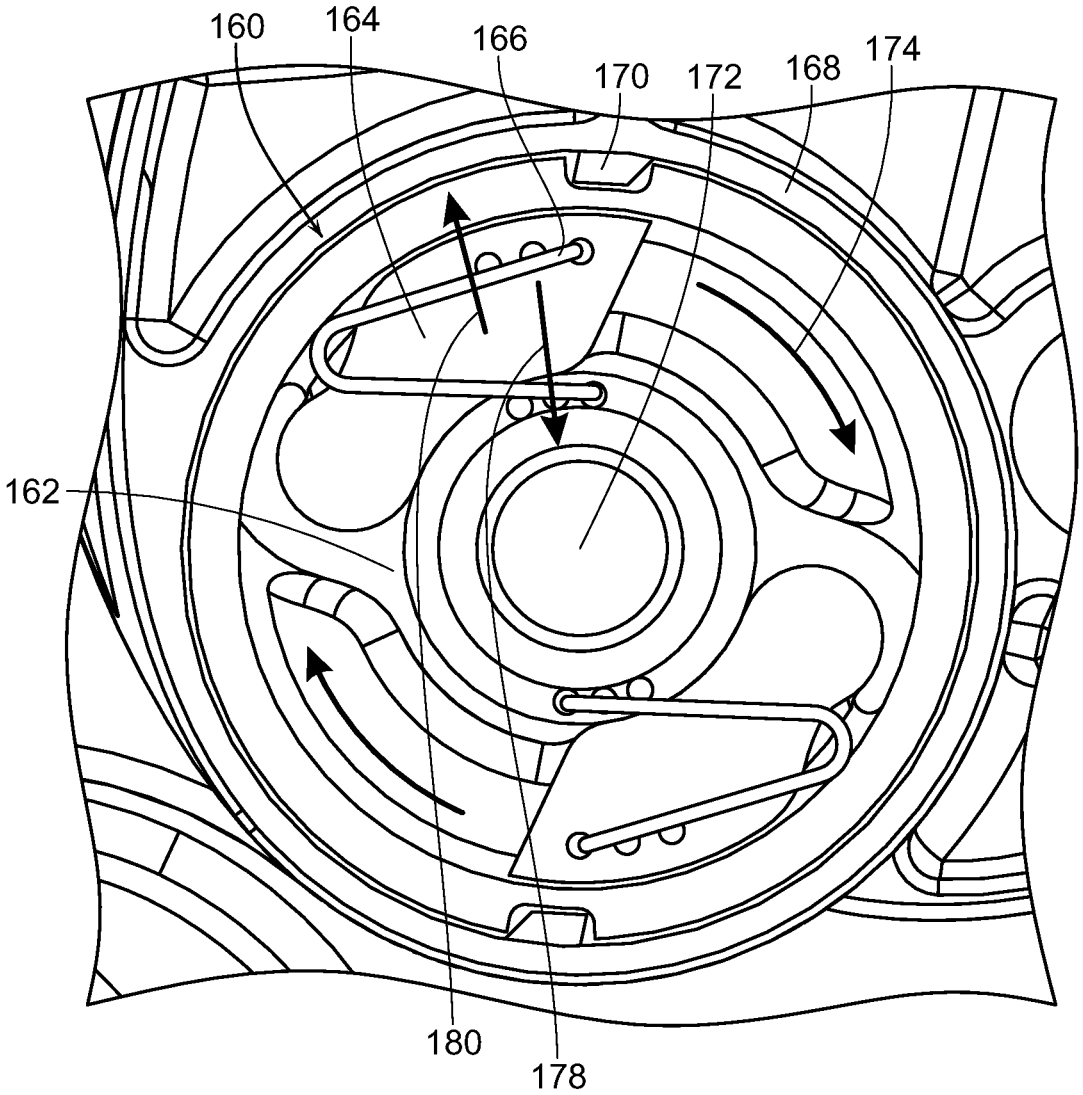
FIG. 9 illustrates a cross-sectional view of the automatic belay system illustrated in FIG. 1 with the cam-clutch mechanism in the disengaged state.
Figure 10:
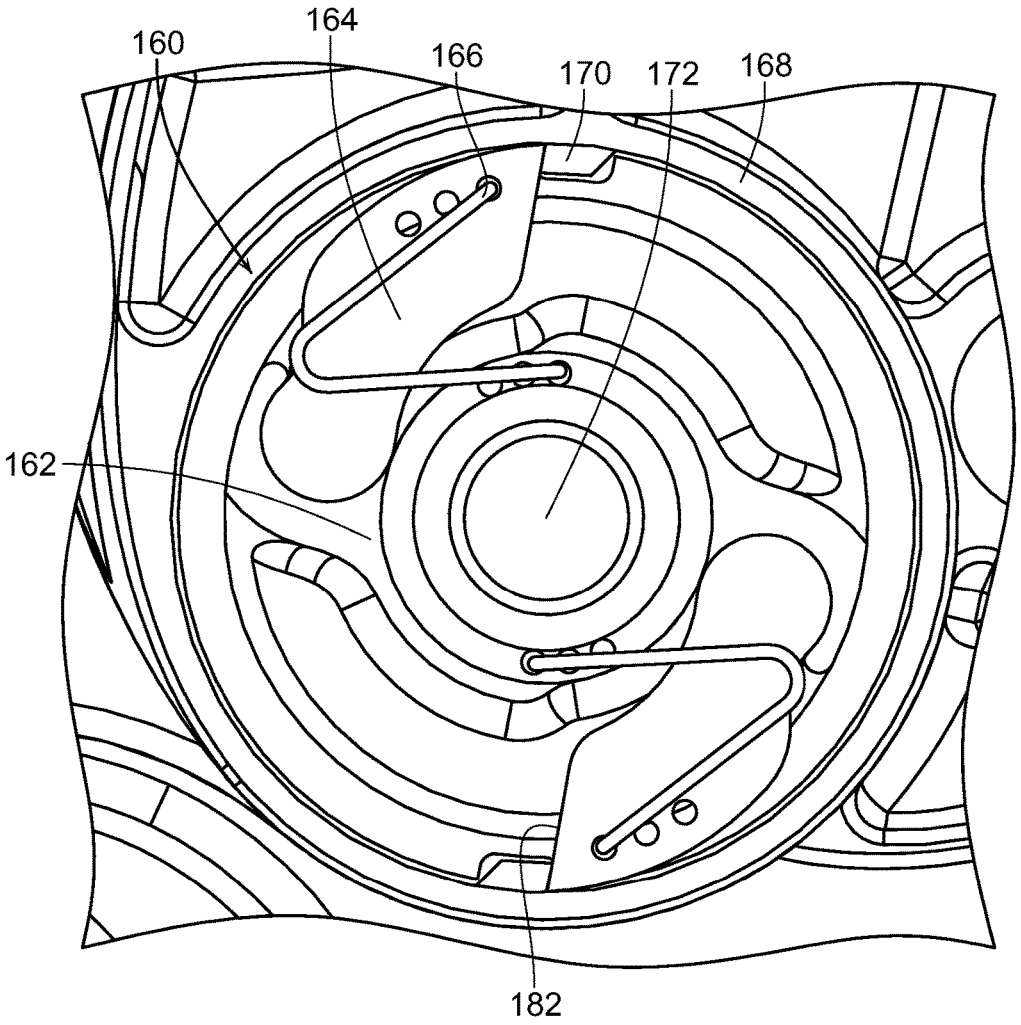
FIG. 10 illustrates a cross-sectional view of the automatic belay system illustrated in FIG. 1 with the cam-clutch mechanism in the engaged state.

Reference is next made to FIG. 5-10, which illustrate specific cross-sectional views of the clutch mechanism 160 portions of the belay system illustrated in FIGS. 1-4. The cross-sectional views are specifically sliced, shaded, and oriented to illustrate components of the system and are not necessarily to scale, nor do they necessarily represent actual operational scenarios. The clutch mechanism 160 includes a cover that prevents visual inspection without cross-sectional views. For example, FIGS. 3 and 4 illustrate the covered clutch mechanism 160 as a circular area within the region of the camming mechanism 140. It will be appreciated that FIGS. 5-10 are non-operational views for the purposes of illustrating the components of the clutch mechanism 160. The clutch mechanism 160 further includes a pulley 162, a set of centrifugal members 164, a set of biasing springs 166, a circular region 168, a stopping surface 170, a clutch rotation point 172, and a pulley rotation 174. The pulley 162 is a substantially cylindrical hourglass shaped member that is disposed within the circular region 168 and adjacent to the rope channel 128. The pulley 162 is oriented and shaped to correspond with the circular region 168 to rotate. A concave hourglass portion of the pulley 162 includes a plurality of pulley friction members 176 exposed within the rope channel 128 and configured to be in translational communication with the rope 110 as it translates through the rope channel 128 (FIG. 7). The pulley friction member 176 are specifically shaped and oriented to impart a frictional force upon the rope 110 so as to detect the translational rate of the rope 110 through the rope channel 128. The frictional force between the rope 110 and the pulley 162 thereby urges the pulley 162 to rotate at a rate that corresponds to the rate at which the rope 110 translates through the system 100. The centrifugal members 164 are elongated members including a flat pawl surface 182 and a rotatable or pivotable coupling to the pulley 162 (FIGS. 5 and 6). The rotatable coupling of the centrifugal members 164 is configured to enable the centrifugal members 164 to pivot between a contracted position (FIG. 5) and an extended position (FIG. 6). The illustrated biasing springs 166 are V-springs coupled to both the pulley 162 and centrifugal members 164 to impart a biasing force 178 (FIG. 9) upon the centrifugal members 164 with respect to the pulley 164. The biasing force 178 is directed internally to bias the centrifugal members 164 toward the contracted position.

The illustrated clutch mechanism 160 is positioned substantially within a portion of the camming mechanism 140 to permit conjunctive operation. In particular, the clutch mechanism 160 is oriented substantially between the entry and exit portions of the rope channel 128 and within the substantially three dimensional region of the camming mechanism 140. The pulley 162 portion of the clutch mechanism 160 is independently rotatable with respect to the camming mechanism 140 and the housing 120. The clutch rotation point 172 is independent (i.e. positioned separately) from the cam rotation point 146. One purpose of the separated rotation points is to enable the clutch mechanism to induce a greater rotational force 150 (via leverage) upon the camming mechanism 140 than that which is created by the independent functionality of the camming mechanism 140. The greater rotational force 150 creates the secondary/backup functionality of the clutch mechanism 160 with respect to the camming mechanism 140 in operation of the system 100.

In operation, the rope 110 is properly loaded into the rope channel 128, the housing 120 is in the closed state, the camming mechanism 140 is in the free state, the clutch mechanism 160 is in the disengaged state, and the system 100 is releasably coupled to the user/belayer. As rope 110 is translated to the climber through the rope channel 128, a frictional force is generated between the pulley friction members 174 and the rope 110, causing the pulley 162 to rotate within the circular region 168. The rotation of the hourglass portion of the pulley 162 is in communication with the rope 110 (See FIG. 7) to cause the portion of the pulley 162 disposed within the circular region 168 (See FIGS. 5 and 6) to correspondingly rotate. The free rotation of the pulley 162 with respect to the circular region 168 is the default/biased disengaged state of the clutch mechanism 160 (FIG. 5). If the climber falls or is lowered at a very high speed, the rope will translate through the system at a correspondingly very high speed/rate, which will cause the pulley 162 to rotate at a correspondingly high speed. The rate of rotation of the pulley 162 within the circular region 168 and the pivotable coupling scheme of the centrifugal members 164 will simultaneously generate a particular centrifugal force 180 upon the centrifugal members 164 with respect to the rotation rate of the pulley 162 (See FIG. 9). The biasing springs 166 induce a particular biasing force 178 upon the centrifugal members 164 with respect to the pulley 162. Once the centrifugal force 180 exceeds the biasing force 178, the centrifugal members 164 radially rotate or pivot from the pulley 162 and engage the flat pawl surfaces 182 with the stopping surfaces 170 of the circular region 168 thereby stopping the pulley 162 from rotating within the circular region 168. It will be appreciated that the illustrated centrifugal members 164 may be referred to as pawls in the particular field of clutch mechanisms because of their shape and functionality. The engagement between the centrifugal members' 164 flat pawl surface 182 and the circular region's 168 stopping surfaces 170 is referred to as the engaged state of the clutch mechanism 160 (FIG. 6). In the disengaged state, the pulley 162 is free to rotate within the circular region 168, within the rope channel 128, and with respect to both the camming mechanism 140 and housing 120. In the engaged state, the pulley 162 is restricted from rotating, thereby translating the frictional force between the rope 110 and the friction members 176 of the pulley 162 into a rotational force 150 upon the camming mechanism 140 (See FIG. 6). The hourglass region of the pulley 162 with the friction members 176 (FIG. 7) thereby functions analogous to the bearing surface 144 of the camming mechanism 140 to cause the camming mechanism 140 to rotate into the cammed state. However, the friction between the friction members 176 and the rope 110 will impart a greater rotational force upon the camming mechanism 140 than that which is created independently by the bearing surface 144 of the camming mechanism 140. As described above with reference to the operation of the camming mechanism 140, the translation of the camming surface 142 across the rope channel 128 upon the rope 110 increases the friction on the rope 110 thereby slowing and/or ceasing the rope 110 from further translation through the system 100. This process thereby automatically locks or arrests the rope 110 in scenarios in which the camming mechanism 140 fails to independently detect and arrest the rope translation. Once the rope 110 translation is suspended, the centrifugal force 180 will be eliminated and the centrifugal members 164 will automatically retract to the contracted position via the biasing force 178 of the biasing springs 166. An optional non-illustrated clutch mechanism 160 disengagement mechanism may be incorporated to selectively disengage the flat pawl surfaces 182 from the stopping surfaces 170. Likewise, it will be appreciated that embodiments of the present invention may function with a single centrifugal member 164, biasing spring 166, and stopping surface 170. The camming mechanism 140 will maintain the cammed state while a sufficient tensile force remains on the rope 110.

It will be appreciated that various non-illustrated alternative embodiments of belay systems with clutch mechanisms may be practiced in accordance with the present invention. One alternative assisted braking belay system may include a clutch-cam mechanism that includes roller type centrifugal members rather than the pawl type described above. In addition, an alternative assisted braking belay system with a clutch-cam mechanism may include clutch and cam mechanisms that have the same rotation point with respect to the housing. Further, an alternative non-illustrated embodiment of an assisted braking belay system in accordance with the present invention may include configuration for operation with two ropes rather than one including but not limited to specific rope channel geometries. The two ropes may be disposed within a similar single rope channel and the system may be configured to respond to either rope independently.

It should be noted that various other alternative system designs may be practiced in accordance with the present invention, including one or more portions or concepts of the embodiment illustrated in FIG. 1 or described above. Various other embodiments have been contemplated, including combinations in whole or in part of the embodiments described above.

What is claimed is:

1. An assisted braking belay system comprising:

a housing including a rope channel, top plate, and bottom plate, wherein the top plate is rotatable between an open state and closed state with respect to the bottom plate, and wherein the rope channel is substantially enclosed between the top plate and bottom plate in the closed state;

a camming mechanism moveably coupled to the housing adjacent to the rope channel, wherein the camming mechanism includes a camming surface, and wherein the camming mechanism is configured to rotate between a biased free state and a cammed state with respect to the housing, and wherein the cammed state includes translating the camming surface across the rope channel and constricting a portion of the rope channel, and wherein the rope channel is substantially curved at at least a forty five degree arc around the camming mechanism; and a clutch mechanism coupled to the camming mechanism including a pulley, a circular region, and a centrifugal member, wherein the centrifugal member is coupled to the pulley and disposed within the circular region, and wherein the clutch mechanism includes an engaged state and a disengaged state, and wherein the engaged state includes obstructing the pulley from rotating within the circular region and the rope channel.

2. The system of claim 1, wherein the centrifugal member is configured to automatically engage with the circular region to cause the clutch mechanism to transition to the engaged state if the pulley rotates above a particular speed.

3. The system of claim 1, wherein rotation of the pulley causes a corresponding centrifugal force upon the centrifugal member, and wherein if the centrifugal force exceeds a particular amount, the centrifugal member automatically engages with the circular region and obstructs the pulley from rotating within the circular region thereby engaging the engaged state.

4. The system of claim 1, wherein the pulley is configured such that translation of an object at a particular rate through the rope channel causes the pulley to rotate at a corresponding speed within the circular region, and wherein if the pulley rotates above a particular speed the clutch mechanism is automatically transitioned to the engaged state.

5. The system of claim 1, wherein the clutch mechanism is coupled to the camming mechanism such that if the clutch mechanism is transitioned to the engaged state, the camming mechanism is transitioned to the cammed state.

6. The system of claim 1, the camming mechanism is configured to automatically engage the cammed state if the centrifugal member engages with the circular region of the clutch mechanism.

7. The system of claim 1, wherein the pulley rotates about a rotational point and wherein the camming mechanism pivots with respect to the housing about a pivot point, and wherein the rotational point of the pulley is independent of the pivot point of the camming mechanism.

8. The system of claim 1, wherein the rotation of the top plate between an open state and closed state with respect to the bottom plate includes an off axis angle at least five degrees away from parallel.

9. The system of claim 1, wherein the pulley includes a concave region disposed adjacent to the rope channel, and wherein the concave region includes a plurality of pulley friction members, wherein the pulley friction members are configured to translate a translational force and rate of an object through the rope channel to a rotational force and rate of the pulley within the circular region.

10. The system of claim 1, wherein centrifugal member is pivotably coupled to the pulley between a contracted position corresponding to the disengaged state of the clutch mechanism and an extended position corresponding to the engaged state of the clutch mechanism, and wherein the centrifugal member is biased to the contracted position by a biasing spring intercoupled with the pulley and centrifugal member, and wherein the extended position includes pivoting the centrifugal member to extend radially beyond the pulley within the circular region.

11. The system of claim 10, wherein the circular region includes a stopping surface, and wherein the extended position includes an engagement of the centrifugal member with the stopping surface.

12. The system of claim 10, wherein the biasing spring is configured to exert a biasing force toward the contracted position of the centrifugal member, and wherein if the pulley rotates above a particular speed a centrifugal force is exerted on the centrifugal member toward the extended position, and wherein if the centrifugal force substantially exceeds the biasing force, the centrifugal member pivots to the extended state.

13. The system of claim 1, wherein clutch mechanism is configured to operate in conjunction with the camming mechanism as a secondary assisted braking mechanism.

14. The system of claim 1, wherein the camming mechanism is configured to engage the cammed state if a rope accelerates through the rope channel above a particular value, and wherein the clutch mechanism is configured to engage theengaged state if a rope translates through the rope channel above a particular speed.

15. The system of claim 1, wherein the rope channel includes an inlet region and an outlet region, and wherein the inlet region and outlet region together form a substantially U shape within the housing, and wherein the camming mechanism and clutch mechanism are disposed substantially between the inlet region and outlet region of the rope channel.

16. The system of claim 1, wherein the camming mechanism includes a bearing surface disposed adjacent to the rope channel and configured to detect the acceleration of a rope through the rope channel.

17. The system of claim 1, wherein the rope channel is substantially curved at at least a hundred and fifty degree arc around the camming mechanism.

18. The system of claim 1, wherein the centrifugal member is an elongated pawl with a flat pawl stopping surface configured to engage with a stopping surface on the circular region in the engaged state.

19. An assisted braking belay system comprising:

a housing including a rope channel, top plate, and bottom plate, wherein the top plate is rotatable between an open state and closed state with respect to the bottom plate, and wherein the rope channel is substantially enclosed between the top plate and bottom plate in the closed state;

a camming mechanism moveably coupled to the housing adjacent to the rope channel, wherein the camming mechanism includes a camming surface, and wherein the camming mechanism is configured to rotate between a biased free state and a cammed state with respect to the housing, and wherein the cammed state includes translating the camming surface across the rope channel and constricting a portion of the rope channel, and wherein the rope channel is substantially curved at at least a forty five degree arc around the camming mechanism;

a clutch mechanism coupled to the camming mechanism including a pulley, a circular region, and a centrifugal member, wherein the centrifugal member is coupled to the pulley and disposed within the circular region, and wherein the clutch mechanism includes an engaged state and a disengaged state, and wherein the engaged state includes obstructing the pulley from rotating within the circular region and the rope channel; and wherein the centrifugal member is configured to automatically engage with the circular region to cause the clutch mechanism to transition to the engaged state if the pulley rotates above a particular speed.

20. An assisted braking belay system comprising:

a housing including a rope channel, top plate, and bottom plate, wherein the top plate is rotatable between an open state and closed state with respect to the bottom plate, and wherein the rope channel is substantially enclosed between the top plate and bottom plate in the closed state;

a camming mechanism moveably coupled to the housing adjacent to the rope channel, wherein the camming mechanism includes a camming surface, and wherein the camming mechanism is configured to rotate between a biased free state and a cammed state with respect to the housing, and wherein the cammed state includes translating the camming surface across the rope channel and constricting a portion of the rope channel, and wherein the rope channel is substantially curved at at least a forty five degree arc around the camming mechanism;

a clutch mechanism coupled to the camming mechanism including a pulley, a circular region, and a centrifugal member, wherein the centrifugal member is coupled to the pulley and disposed within the circular region, and wherein the clutch mechanism includes an engaged state and a disengaged state, and wherein the engaged state includes obstructing the pulley from rotating within the circular region and the rope channel; and wherein the camming mechanism is configured to engage the cammed state if a rope accelerates through the rope channel above a particular value, and wherein the clutch mechanism is configured to engage the engaged state if a rope translates through the rope channel above a particular speed.

* * * * *